US007481589B2

(12) United States Patent
Yin

(10) Patent No.: US 7,481,589 B2
(45) Date of Patent: Jan. 27, 2009

(54) BRAILLE PEN WRITER

(76) Inventor: Courtney Yin, 547 Sullivan Dr., Mountain View, CA (US) 94041

( * ) Notice: Subject to any disclaimer, the term of this patent is extended or adjusted under 35 U.S.C. 154(b) by 384 days.

(21) Appl. No.: 11/321,933

(22) Filed: Dec. 30, 2005

(65) Prior Publication Data

US 2007/0160404 A1 Jul. 12, 2007

(51) Int. Cl.
*B41J 3/01* (2006.01)

(52) U.S. Cl. ..... 400/109; 400/109.1

(58) Field of Classification Search ..... 101/18; 400/109, 124.29

See application file for complete search history.

(56) References Cited

U.S. PATENT DOCUMENTS 5,209,584 A * 5/1993 Galarneau ..... 400/109.1
5,876,128 A * 3/1999 Ogawa et al. ..... 400/109.1

*Primary Examiner*—Judy Nguyen
*Assistant Examiner*—Marissa L Ferguson-Samreth

(57) ABSTRACT

A Braille writing instrument has a housing which has a first end and a second end, extending in a first direction. Six plungers are positioned near the first end, arranged in a first column of three plungers and a second column of three plungers. The first and second columns are adjacent to one another to define three rows of plungers with each row having two plungers. Each plunger is movable in the first direction between a stored position and a write position. The instrument further has six styluses which are positioned near the second end, and are arranged in a first column of three styluses and a second column of three styluses. The first and second columns of styluses are adjacent to one another to define three rows of styluses with each row having two styluses. Each stylus is movable in the first direction between a retracted position and an extended position. Styluses in the first column are substantially collinear with the plungers in the first column, and styluses in the second column are substantially collinear with the plungers on the second column. The instrument has means for connecting each plunger in the first column to a stylus in the second column in the same row, and each plunger in the second column to a stylus in the first column in the same row. Each movement of a plunger from the stored position to the write position causes its connected stylus to move from the retracted position to the extended position.

* cited by examiner

5 Claims, 3 Drawing Sheets

BRAILLE PEN WRITER

TECHNICAL FIELD

The present invention relates to a Braille pen writer and more particularly to a mechanical Braille pen writer that can write a character of Braille symbol at once.

BACKGROUND OF THE INVENTION

Braille is the language for the sight disadvantaged. In the Braille language, each character of the alphabet is represented by one or more raised dimples, formed in a matrix of 3×2 dimples, wherein 3 dimples extend in a longitudinal direction and 2 dimples extend in a horizontal direction. A sight disadvantaged person reads each Braille character by moving his/her finger(s) over the raised dimples of each character. Where the dimples are raised they define each different character of the alphabet.

There are a number of Braille writing instruments in the prior art. One of the instruments uses a simple stylus to press through one of 6 holes that are arranged in a 3×2 matrix. Referring to FIG. 1 there is shown a template 10 used in the writing instrument of the prior art. The template 10 has a large number of holes, with a group of six holes (A, B, C, D, E, F) arranged in two columns (A, C, E) and (B, D, F) with three rows of two holes each (AB, CD, EF) defining one Braille character. A stylus is used to press through one of the holes of the template 10 against a material, such as piece of paper to form a raised dimple (raised in the side underneath the paper). This writing instrument is tedious to use for two reasons. First, to form a single character, one must press through a number of holes (as many as six) in the template 10. More significantly, because the raised dimples are formed on the side beneath the paper which the stylus impinges, the character formed is a mirror image of the desired character. Thus, for example, to form a character having raised dimples A, D, F, (looking at FIG. 1) the writer has to use the stylus to press through holes B, C, E. Therefore, to write a character, the writer has to write a mirror image character of the desired Braille character.

A second writing instrument of the prior art is a Braille typewriter. The typewriter has 6 keys denoting the six possible raised dimples that can be formed on a piece of paper. The user "types" the desired Braille character by simultaneously depressing one or more of the keys to activate one or more styluses, which then impinge the paper which is seated on a rubber cylinder. Although the character formed by a Braille typewriter is "right side" up, a typewriter is not portable and simple to use.

Another Braille writing instrument is a Braille printer connected to a computer. The Braille printer is similar to a dot matrix printer in that it has a plurality of styluses that impinge the paper simultaneously. Similar to a Braille typewriter, a Braille printer is not easily portable and requires a computer to operate.

Accordingly, there exists a need for a simple Braille writing instrument that is easy to use, and is portable.

SUMMARY OF THE INVENTION

A Braille writing instrument comprises a housing having a first end and a second end, extending in a first direction. Six plungers are positioned near the first end, arranged in a first column of three plungers and a second column of three plungers. The first and second columns are adjacent to one another to define three rows of plungers with each row having two plungers. Each plunger is movable in the first direction between a stored position and a write position. Six styluses are positioned near the second end, arranged in a first column of three styluses and a second column of three styluses. The first and second columns are adjacent to one another to define three rows of styluses with each row having two styluses. Each stylus is movable in the first direction between a retracted position and an extended position. Styluses in the first column are substantially collinear with the plungers in the first column, and styluses in the second column are substantially collinear with the plungers on the second column. The writing instrument further has means for connecting each plunger in the first column to a stylus in the second column in the same row, and each plunger in the second column to a stylus in the first column in the same row. Each movement of a plunger from the stored position to the write position causes its connected stylus to move from the retracted position to the extended position.

BRIEF DESCRIPTION OF THE DRAWINGS

FIG. 2*a* is a top view of a first embodiment of a Braille writing instrument of the present invention, while

DETAILED DESCRIPTION OF THE INVENTION

Figure 1:
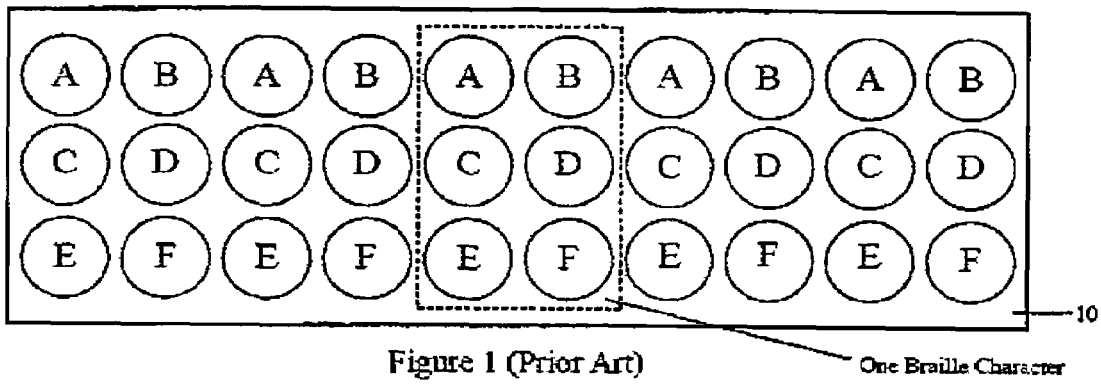
Figure 1 (Prior Art)
FIG. 1 is a template used in the Braille instrument of the prior art.
Figure 2A:
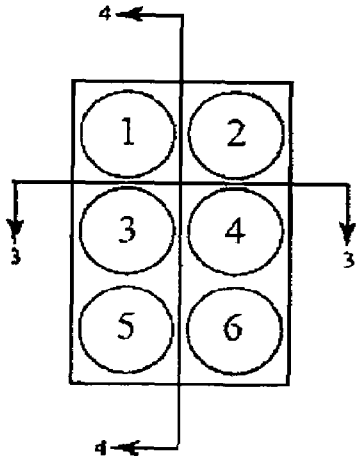
Figure 3:
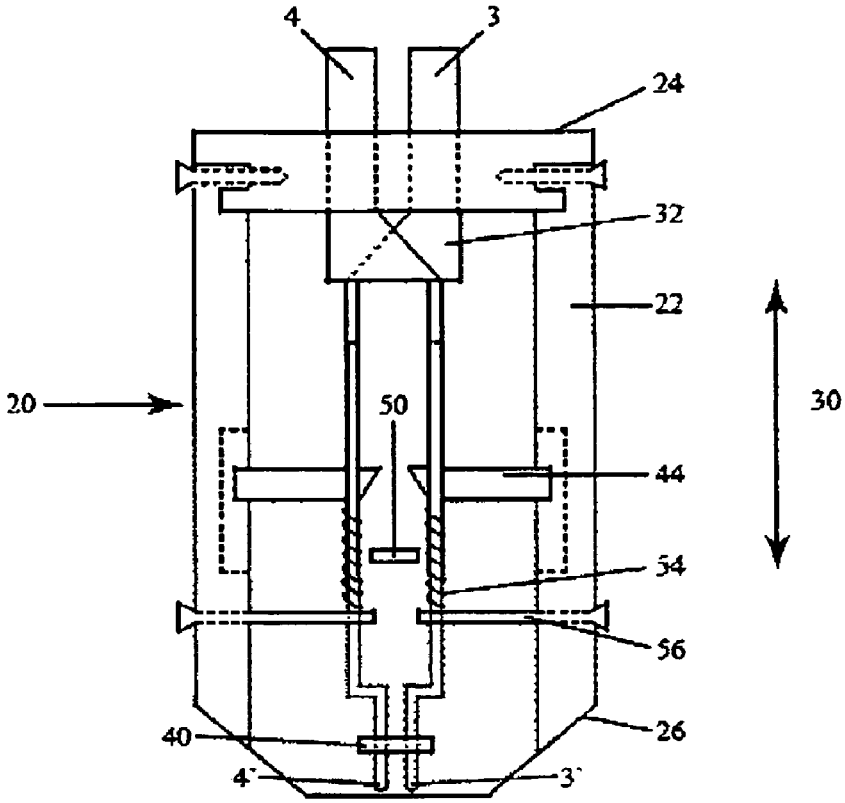
FIG. 3 is a cross-sectional side view of a first embodiment of the Braille writing instrument of the present invention shown in FIG. 2 taken along the lines 3-3.
Figure 4:
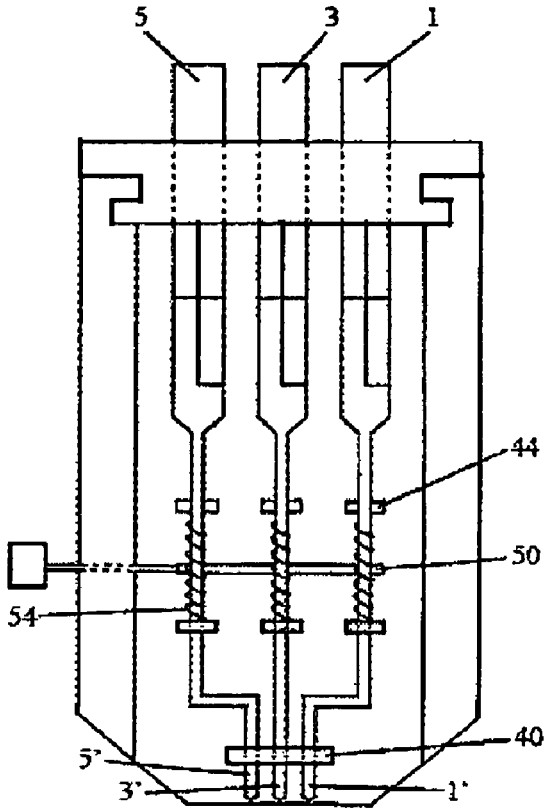
FIG. 4 is a cross-sectional side view of a first embodiment of the Braille writing instrument of the present invention shown in FIG. 2 taken along the lines 4-4.

Referring to FIG. 2*a* there is shown a top view of a first embodiment of a Braille writing instrument 20 of the present invention. A cross-sectional view of the first embodiment of the writing instrument 20, taken along the line 3-3, is shown in FIG. 3, while another cross-sectional view, orthogonal to that shown in FIG. 3, taken along the line 4-4, is shown in FIG. 4. The writing instrument 20 comprises a housing 22 having a first end 24 and a second end 26. Six substantially cylindrically shaped plungers (1-6) are located at or near the first end 24 or the top end 24. Each of the plungers (1-6) can be activated to move in the direction 30, from a stored position to a write position. In the first embodiment of the writing instrument 20, the write position is downward from the stored position.

The six plungers (1-6) are arranged in a substantially 3×2 matrix, as shown in FIG. 2*a*. Thus, the plungers (1-6) are arranged such that three plungers (1,3,5) are aligned in one column, while the plungers (2,4,6) are aligned in an adjacent column. Further the plungers (1-6) form three rows of two plungers in each row (1-2; 3-4; and 5-6).

Figure 2B:
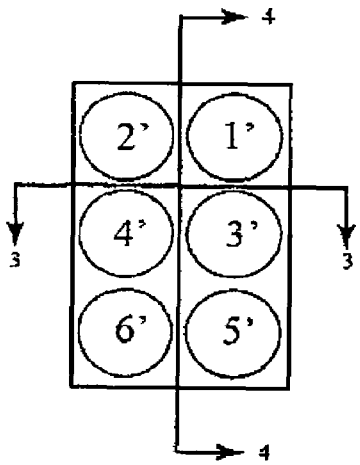
FIG. 2*b* is a bottom view of the first embodiment.

Each of the plungers (1-6) has a stylus (1'-6'), shown in FIG. 2*b*, aligned substantially co-linear with a corresponding plunger. However, as will be seen, and discussed, the movement of a plunger, e.g. plunger 3 (shown in FIG. 3) in the direction 30 causes the stylus 4', which is the stylus co-linear with the adjacent plunger 4 to move in the direction 30. Thus, hereafter, the stylus aligned substantially co-linear with a plunger, e.g. stylus 3' aligned substantially co-linear with the plunger 3 shall be referred to as the corresponding stylus. However, the stylus which is moved by the movement of the plunger, e.g. stylus 4', which is moved when the plunger 3 is moved, shall be referred to as the associated stylus. As seen from the foregoing discussion, the associated stylus and the corresponding stylus are also aligned in a row. Each stylus (1'-6') is movable between a retracted position and an extended position. In the retracted position, the stylus (1'-6') remains in the interior of the housing 22; in the extended position, the stylus (1'-6') is exterior to the housing 22. The movement of a plunger, e.g. 3, from the stored position to the write position, causes the associated stylus, e.g. 4', to extend from the retracted position to the extended position. In the first embodiment of the writing instrument 20, shown in FIGS. 2(*a* & *b*)-6, the movement of a plunger from a stored position to a write position, causes the associated stylus to move a substantially equal amount in the same direction from the retracted position to the extended position. Thus the distance between the outermost tip of a plunger in the stored position to the tip of the associated stylus in the refracted position is substantially the same as the distance between the outermost tip of a plunger in the write position to the tip of the associated stylus in the extended position.

Figure 5:
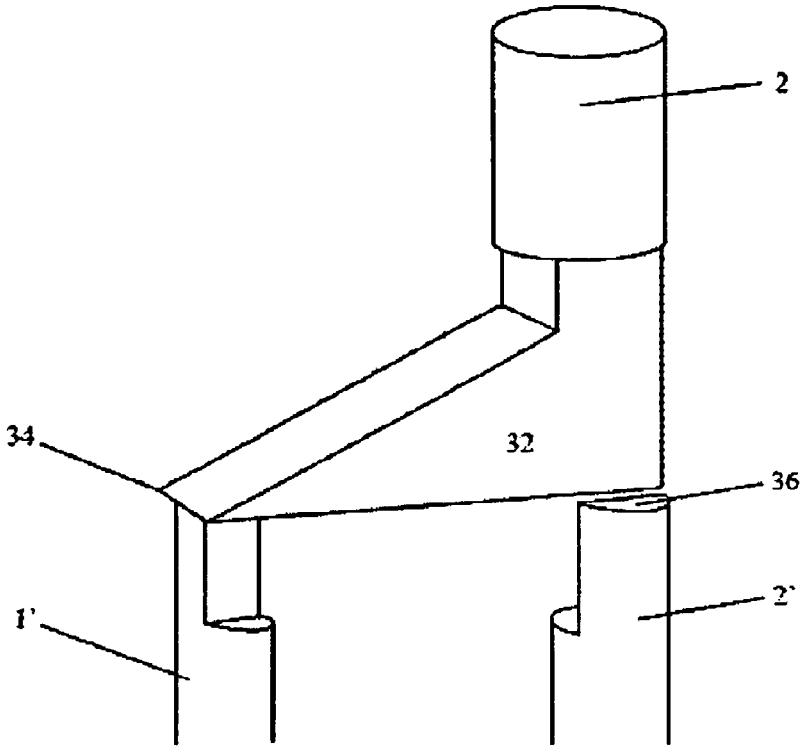
FIG. 5 is a perspective view of a portion of the first embodiment of the Braille writing instrument of the present invention shown in FIG. 2 of the connecting member that connects a plunger to its associated horizontally translated stylus.

A connecting member 32 connects each plunger with its associated stylus. Referring to FIG. 5, there is shown a perspective view of one plunger 2 with its connecting member 32 connecting the plunger 2 to its associated stylus 1'. In one embodiment the plunger 2 is substantially cylindrically shaped, with a radius of R. The connecting member 32 is a triangularly shaped member having a width 34 which is substantially equal to R. Each of the stylus 1' and stylus 2' is also substantially cylindrically shaped; however, near the connecting member 32, each of the styluses 1' and 2' has a substantially hemi-cylindrical cross-section 36. The connecting member 32 connects the plunger 2 and rests against the hemi-cylindrical cross section 36 of the associated stylus 1'. Thus, another connecting member can connect the plunger 1 to the stylus 2' with the triangularly shaped connecting member 32 resting against the hemi-cylindrical cross-section of the stylus 2' in the same row. In this manner the plungers 1 and 2 remain in the same row, while the styluses 1'-2' also remain in the same row. Further activation of the plunger, e.g. plunger 2 in the direction 30 causes the connecting member 32 to move in the direction 30 , which then pushes only the associated stylus 1' in the direction 30. In this manner, the activation of a plunger in the direction 30 causes the associated stylus , which is the mirror image of the plunger, to move in the same direction. Thus, there are six identical connecting members 32: connecting plunger 1 to it associated stylus 2'; connecting plunger 2 to its associated stylus 1'; connecting plunger 3 to its associated stylus 4'; connecting plunger 4 to its associated stylus 3'; connecting plunger 5 to its associated stylus 6'; and connecting plunger 6 to its associated stylus 5'. Since all six connecting members 32 are identical, only one is illustrated.

Referring to FIG. 3, it can be seen that each stylus has a stop member 44, a spring 54, and an urging member 56. The urging member 56 is attached to the housing 22, and therefore, does not move when the stylus moves. The stop member 44, however, is attached to the stylus and moves as the stylus moves. The stop member 44 protrudes substantially in a direction perpendicular to the direction 30. Between the stop member 44 and the urging member 56 is a spring 54. As the stylus is moved downward caused by the movement of the associated plunger, the stylus causes the stop member 44 to compress the spring 54. The stop member 44 would move past a release member 50. Once the stop member 44 moves past the release member 50, and the plunger is released, the stylus would move upward caused by the spring 54 urging the stop member 44 upward. However, the stop member 44 would come to rest against the back side of the release member 50, where it stays, with the stylus remaining in the extended position. Thus, once the particular plungers have been moved and the associated styluses have been extended, the associated styluses would remain in the extended position.

Figure 6:
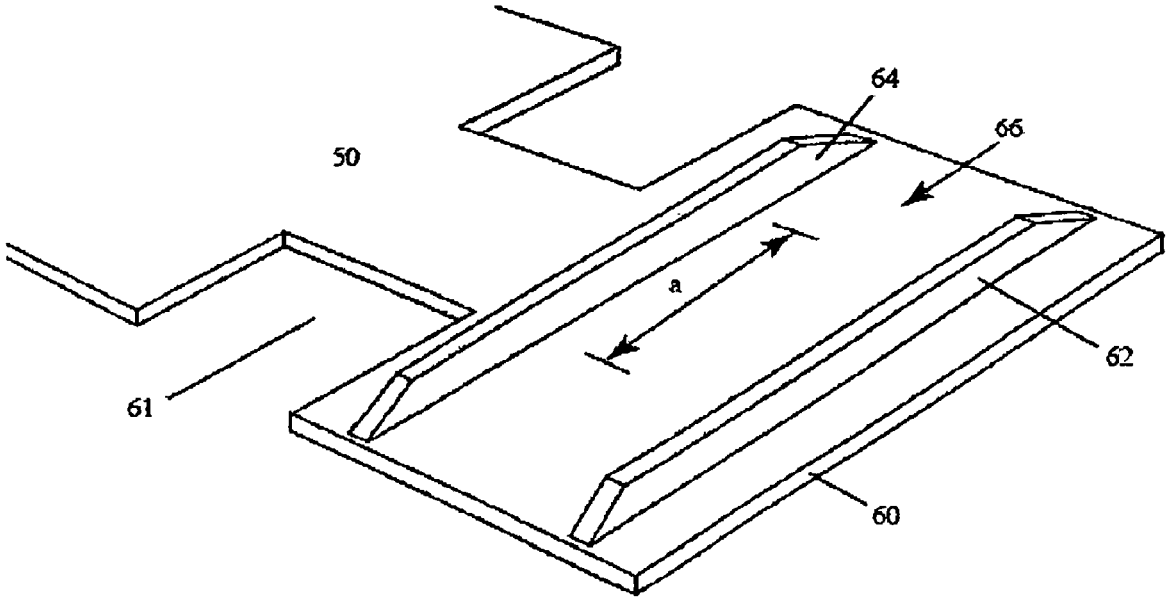
FIG. 6 is a perspective view of a portion of a release member with a flexible membrane used in the first embodiment of the Braille writing instrument shown in FIG. 1.

After the user has pressed the instrument 20 against a piece of paper and has created the Braille character, the release member 50 is activated to cause all of the extended styluses to retract into the retract position. Referring to FIG. 6 there is shown a perspective view of a portion of the release member 50. The release member 50 comprises a flexible member 60. Two stiffening members 62 and 64, are attached to the flexible member 60 near the central portion "a" of the flexible member 60. The stiffening members 62 and 64 are substantially parallel to one another, forming a groove 66 therebetween. The groove 66 is of a width to permit the stop member 44 to pass through, between the stiffening members 62 and 64. Because the flexible member 60 is flexible near the periphery, i.e. outside of the region "a", as the stylus is extended downward, the stop member 44 passes between the stiffening members 62 and 64 in the groove 66 causing the flexible member 60 to flex downward. However, after the stop member passes through the flexible member 60, the upward force of the spring 54 would push the stop member 44 against the back side of the flexible member 60. Since the flexible member 60 is stiffened by the stiffening members 62 and 64 on the front side, the flexible member 60 is unable to flex upward, causing the stop member 44 to rest against the back side of the flexible member 60.

When it is desired to release the all the styluses and to cause them to all return to the retracted position, the release member 50 is moved laterally, i.e. in a direction substantially perpendicular to the direction 30, causing each of the stop members 44 to pass through the groove 61, where the action of the spring 54 causes the stop member 44 to pass through the groove 61 to bring each extended stylus back into the retracted position.

Figure 7:
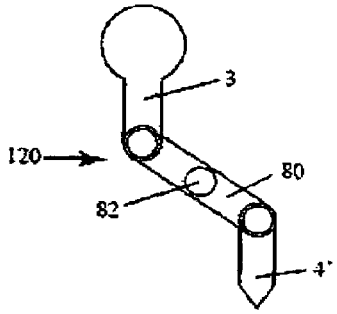
FIG. 7 is a side view of a connecting member used in a second embodiment of a Braille writing instrument of the present invention.

Referring to FIG. 7, there is shown a side view of a connecting member 80 used in a second embodiment of a writing instrument 120 of the present invention. The second embodiment of a writing instrument 120 is similar to the first embodiment 20. Thus like numerals will be used to refer to similar parts. The only difference between the second embodiment 120 and the first embodiment 20 is that the connecting member 80 is a longitudinal member having two ends, pivoting about a central pivot 82. The plunger (1-6) is connected to the connecting member 80 at one end, while the associated stylus is connected to the connecting member 80 at another end. Thus, when the plunger, e.g. 3 is pulled, i.e. moved upwardly, the plunger pulls the connecting member 80 upward. However, because the connecting member 80 is tied at the pivoting point 82, the upward pulling of one end causes the downward extension of the other end of the connecting member 80. This causes the associated stylus, e.g. 4', to extend downwardly pushing the stylus from the retracted position to the extended position. Therefore, in this embodiment 120, the upward pulling of the plunger from its stored position to the write position causes the associated stylus to extend outwardly from a retracted position within the housing 22 to and extended position outside of the housing 22. In short, the distance between the tip of the plunger in the stored position to the tip of the associated stylus in the retracted position is less than the distance between the tip of the plunger in the write position to the tip of the associated stylus in the extended position.

As can be seen from the foregoing, the Braille pen instrument of the present invention is portable and can write a character at once, without the need to "write" a mirror image of the desired character.

What is claimed is:

1. A Braille writing instrument comprising:

a housing having a first end and a second end, extending in a first direction;

six plungers positioned near the first end, arranged in a first column of three plungers and a second column of three plungers, wherein the first and second columns are adjacent to one another to define three rows of plungers with each row having two plungers, wherein each plunger is movable in the first direction between a stored position and a write position;

six styluses positioned near the second end, arranged in a first column of three styluses and a second column of three styluses, wherein the first and second columns are adjacent to one another to define three rows of styluses with each row having two styluses, wherein each stylus is movable in the first direction between a retracted position and an extended position, wherein styluses in the first column are substantially collinear with the plungers in the first column, and styluses in the second column are substantially collinear with the plungers on the second column;

means for connecting each plunger in the first column to a stylus in the second column in the same row, and each plunger in the second column to a stylus in the first column in the same row, wherein each movement of a plunger from the stored position to the write position causes its connected stylus to move from the refracted position to the extended position;

a stop member connected to each stylus, protruding in a direction substantially perpendicular to the first direction; and a release member, having a one way flexible membrane, flexible in the first direction, wherein each stylus in the retracted position is positioned to a first side of the flexible membrane, and in the extended position abuts the flexible membrane to a second side of the flexible membrane, wherein the first side is interior to the second side.

2. The Braille writing instrument of claim 1 wherein the distance between the stored position and the refracted position is less than the distance between the write position and the extended position.

3. The Braille writing instrument of claim 1 wherein the distance between the stored position and the retracted position is substantially the same as the distance between the write position and the extended position.

4. The Braille writing instrument of claim 3 further comprising a spring means associated with each stylus, urging each stylus in the retracted position.

5. The Braille writing instrument of claim 1 wherein said release member is movable in a second direction substantially perpendicular to the first direction, between an engaged position and a release position, wherein in the engaged position, said flexible membrane of the release member is aligned in the first direction with the stop member of each stylus, wherein in the release position, the flexible membrane is offset from the stop member in a direction perpendicular to the first direction.

* * * * *